United States Patent [19]

Adkins et al.

[11] Patent Number: 5,065,192

[45] Date of Patent: Nov. 12, 1991

[54] DEVELOPMENT APPARATUS WITH MAGNETICALLY ROTATED SKIVE

[75] Inventors: Kenneth D. Adkins, Rochester; Rodney R. Bucks, Webster, both of N.Y.

[73] Assignee: Eastman Kodak Company, Rochester, N.Y.

[21] Appl. No.: 429,449

[22] Filed: Oct. 31, 1989

[51] Int. Cl.[5] ..... G03G 15/09

[52] U.S. Cl. ..... 355/251; 118/657; 355/245

[58] Field of Search ..... 355/251, 253, 245, 269; 118/656, 657, 658

[56] References Cited

U.S. PATENT DOCUMENTS

| | | | |
|---|---|---|---|
| 2,975,758 | 3/1961 | Bird, Jr. | 355/251 |
| 3,920,329 | 11/1975 | Dennie et al. | 355/297 |
| 3,982,498 | 9/1976 | Wilcox | 355/253 |
| 4,044,719 | 8/1977 | Ohmori | 118/658 X |
| 4,053,218 | 10/1977 | Mikolas | 355/269 |
| 4,418,357 | 11/1983 | Huss | 118/657 X |
| 4,452,173 | 6/1984 | Tabuchi et al. | 118/657 X |
| 4,461,238 | 7/1984 | Baier et al. | 355/253 |
| 4,537,494 | 8/1985 | Lubinsky et al. | 355/251 |
| 4,570,570 | 2/1986 | Masham | 118/612 |
| 4,602,863 | 7/1986 | Fritz et al. | 118/657 X |
| 4,613,554 | 9/1986 | Quang et al. | 118/657 X |
| 4,660,504 | 4/1987 | Weitzel | 355/253 |
| 4,690,096 | 9/1987 | Hacknauer et al. | 118/658 X |
| 4,714,046 | 12/1987 | Steele et al. | 355/253 X |
| 4,748,471 | 5/1988 | Adkins | 118/657 X |

FOREIGN PATENT DOCUMENTS

| | | | |
|---|---|---|---|
| 0113073 | 9/1980 | Japan | 355/251 |
| 0042570 | 3/1984 | Japan | 355/253 |
| 0153067 | 8/1985 | Japan | 355/251 |

*Primary Examiner*—A. T. Grimley
*Assistant Examiner*—Nestor R. Ramirez
*Attorney, Agent, or Firm*—Tallum I. Nguti

[57] ABSTRACT

A compact and less costly development apparatus includes a first magnetic field generated by a driven magnetic development roller, and a second magnetic field generated by a magnetic skive for effectively removing spent developer material from the development roller. The magnetic skive which consists of a stationary non-magnetic shell and a rotatable multiple pole magnetic core, is rotatably driven by a magnetic coupling formed by such first and second magnetic fields.

10 Claims, 1 Drawing Sheet

DEVELOPMENT APPARATUS WITH MAGNETICALLY ROTATED SKIVE

BACKGROUND OF THE INVENTION

This invention relates to electrostatographic copiers and printers, and more particularly to a compact and less expensive development apparatus therein for producing high quality toner developed images.

In such a copier or printer, especially one for producing high-resolution images, a development apparatus, of the type including a magnetic development roller, utilizes very fine toner particles that are contained in a magnetic developer material. The developer material is carried, at a desired velocity, by the magnetic development roller for developing electrostatic latent images on an image-bearing member. Such developer material consists, for example, of a mixture of ferromagnetic carrier particles and such toner particles, at a desired concentration. The concentration or level of toner particles in the mix, as expected, is usually depleted each time an image is developed.

Ordinarily, such depletion will result in poor quality development of subsequently produced images. Therefore to ensure quality development of such subsequently developed images, the depleted spent developer must, for example, be effectively removed from each portion of the development roller, before such portion again carries fresh developer (of the desired concentration) for development.

Conventional devices for skiving or removing spent developer from the surface of development rollers are disclosed, for example, in U.S. Pat. Nos. 2,975,758; 4,660,504 and 3,982,498. These devices include, respectively, an eccentric shell about a magnetic development roller, a mechanical skive, and a magnetic brush roll.

The eccentric shell type device operates by directing the spent developer further and further away from the magnetic influence of the magnetic core of the development roller until the spent developer passively falls off gravitationally from the surface of such shell. Ordinarily, the effectiveness of such eccentric shell devices is limited because the spent developer is removed passively, and because there is a contradictory and competing need on the other hand for the same surface of the eccentric shell to be within the magnetic influence of its magnetic core so as to enable the development roller to magnetically attract fresh developer thereto from an adjacent developer feed roller.

Mechanical skive devices are often also ineffective. They typically include a mechanical edge located in skiving or scraping engagement with the developer-carrying outside surface of a development roller shell, for scraping spent developer therefrom. The spent developer so scraped off is thereafter allowed to gravitationally fall off the mechanical skive. Such mechanical skives, however, are particularly ineffective in development apparatus which utilize very fine toner particles for high resolution image development. In such development apparatus, the shell and the core of the development roller normally are being rotated in the same direction such that the net forward velocity of the spent developer is imparted by the shell. Such a net velocity, of course, will be opposite in direction to the component velocity being imparted by the magnetic core of such development roller.

The mechanical skive is particularly ineffective here because when the spent developer is still within the magnetic influence of the core of the development roller, and loses its shell-imparted forward velocity due to being scraped or skived from such shell, the magnetic tendency of the core will be to move the spent developer backwards away from the mechanical skive. The results often are undesirable bridging, and flaking of the toner component of such developer.

On the other hand, although it is well known to use a magnetic device such as a development roller or magnetic brush roll to move developer-containing magnetic carrier particles, the effectiveness of such a roll, when used as a skive for a magnetic development roller, is significantly limited if it must work against, and must overcome the magnetic influence of the magnetic core of the development roller in order to remove spent developer from such development roller. Furthermore, because such rolls normally include a driven shell and hence separate drive means, the tendency is for them to be bulky and expensive.

SUMMARY OF THE INVENTION

It is an object of the present invention to provide in a development apparatus having a development roller, a skiving device for actively skiving spent developer from such development roller.

It is another object of the present invention to provide in such a development apparatus, a skiving device which does not adversely affect the ability of the development roller to magnetically pick up fresh developer from a development supply roller.

It is still another object of the present invention to provide a skiving device that is effective in skiving spent developer from the development roller of a high-resolution development apparatus in which the shell and core of the development roller are being rotated in the same direction, and in which the net forward velocity of the developer is imparted by the shell, oppositely to that being imparted by the core.

A further object of the present invention is to provide a development apparatus that includes such a skiving device, and that is compact and inexpensive.

In accordance with the present invention, a development apparatus, in an electrostatographic copier or printer, includes a drivable magnetic development roller generating a first magnetic field for picking up and carrying fresh developer material within the apparatus. The apparatus further includes a rotatable magnetic skiving device, generating a second magnetic field, for effectively skiving and removing developer material from such development roller, and a magnetic coupling formed by such first and second magnetic fields for rotating such a skiving device within the apparatus.

BRIEF DESCRIPTION OF THE DRAWINGS

In the detailed description of the preferred embodiment of the present invention below, reference is made to the accompanying drawings, in which.

DETAILED DESCRIPTION OF A PREFERRED EMBODIMENT

Figure 1:
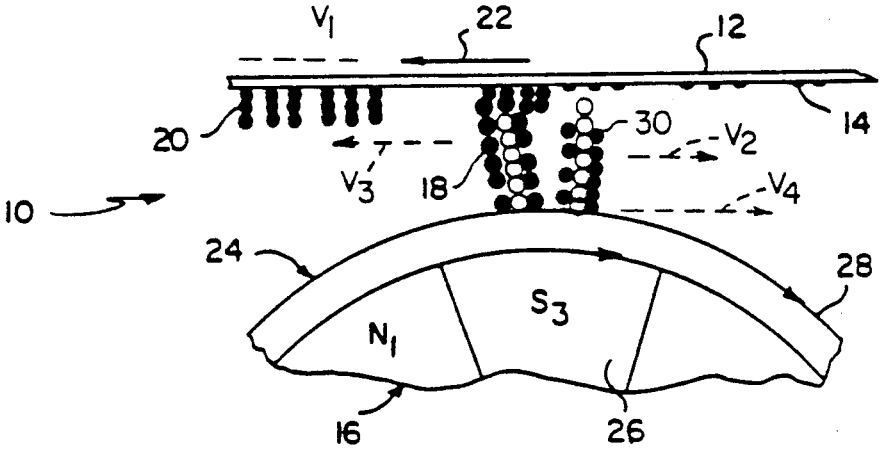
FIG. 1 is a partial illustration of a development apparatus showing a development roller carrying developer for developing electrostatic latent images on an image-bearing member.

Referring now to the drawings, FIG. 1 illustrates a portion of a development apparatus, in an electrostatographic copier or printer, that includes a development zone generally designated 10, and that is suitable for high-resolution image development. The development zone 10 includes part of an image-bearing member 12 carrying electrostatic latent images 14, and part of a development roller 16 carrying fresh developer material 18 for developing the latent images 14, turning them into visible toner images 20.

As illustrated, the image-bearing member 12 is moved in the direction of arrow 22 at a given, slow velocity $V_1$. The development roller 16, which consists of a non-magnetic shell 24 and a magnetic core 26, is moved so that its shell 24 and its core 26 are both traveling rotatably in the same direction, for example, clockwise as illustrated, and so that the development roller 16 imparts a net linear velocity $V_2$ to the developer material thereon. As is well known, when the magnetic core 26 is being rotated, for example, in the clockwise direction as shown, it will magnetically tend to impart a linear velocity $V_3$ to the magnetized developer material 18 such that $V_3$ is opposite in direction to the rotational direction of the core 26. On the other hand, the non-magnetic shell 24 on which the developer material 18 actually rides, will impart a velocity $V_4$ to the developer 18 such that $V_4$ is in the same direction as the rotation of the shell 24, and therefore against $V_3$, as shown. As such, if $V_4$ is made greater than $V_3$, the net velocity $V_2$ of the developer 18 will be in the same direction as the rotation of the shell 24 and core 26, and can thus be made as small, that is, as slow as is desired, even to the point where $V_4-V_3$ is practically zero.

Accordingly, the fresh developer material 18 which is comprised of a mix of small magnetic carrier particles and pigmented toner particles at a desired concentration or level, can be picked up and carried on a portion of the outside surface 28 of the shell 26 at the high counteracting linear velocities $V_3$ and $V_4$ (which result in the net velocity $V_2$) for high resolution development of the latent images 14.

Figure 2:
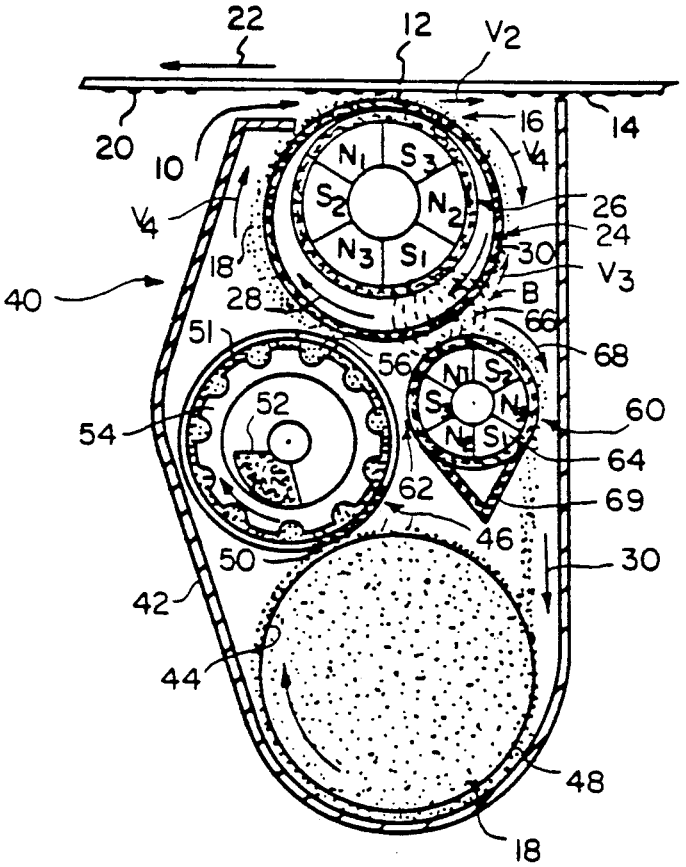
FIG. 2 is a schematic of development apparatus of the present invention.

For such development, a development apparatus 40, as shown in FIG. 2, is located within the copier or printer so that during rotation of the shell 24 and core 26 of the development roller, as described above, the developer material 18 (on the surface 28 of the shell) will come into brushing contact with the latent images 14. During such brushing contact, some of the toner particles in the fresh developer 18 on each portion of the surface 28, are spent or used up in development, thereby leaving spent developer 30 on such portion. Such spent developer 30, as expected, has a reduced and less than desired concentration or level of toner particles therein, and should therefore be effectively removed from such portion in order to prevent poor image development resulting from undesirable dilution of other fresh developer 18 subsequently picked up by such portion.

FIG. 2 fully illustrates the development apparatus 40 of the type forming the development zone 10 of FIG. 1. The development apparatus 40 as illustrated includes the development roller 16, as well as, skiving means for effectively removing such spent developer 30 from the development roller 16. As shown, the development apparatus 40 comprises a housing 42 in which is located a mixing device 44 for mixing and blending the developer material 18, a developer material feed roller 46, the development roller 16, and a skiving device 60.

The mixing device 44 is located in a sump portion 48 of the housing 42, and rotates to blend or mix the toner and carrier particles that constitute the developer mix 18. The blended developer 18 is pulled into the feed roller 46 through a first aperture 50 in a hollow non-magnetic shell 51, by means of a stationary magnet 52. Inside the shell 51, a non-magnetic fluted core 54 mechanically carries the developer 18 passed a second aperture 56 that is adjacent the development roller 16.

The development roller 16 includes the rotatable non-magnetic shell 24, and the rotatable magnetic core 26 which consists of a plurality e.g. (6) of single, alternating N and S pole magnets. Each of these magnets is strong enough to generate a magnetic field of a first strength about the shell 24. As shown, the shell 24 is eccentric with the core 26, but it can also be concentric. As described above, the shell 24 and core 26 are rotatably driven in the same direction (clockwise as shown), with the core being rotated fast enough to induce the high linear velocity $V_3$, and the shell 24 being simultaneously rotated fast enough at a counteracting linear velocity $V_4$, thereby resulting in a net linear velocity $V_2$ (for the developer material 18).

The development roller 16 and the feed roller 46 are located so that developer material 18 being carried by the fluted core 54, passed the second aperture 56, will be within the influence of each magnetic field of the core 26 as such field is moved with the core 26 passed the aperture 56. As such, a quantity of the developer 18 will be magnetically attracted by the passing magnetic field of the core 26 through the aperture 56, and onto a portion of the outside surface 28 of the non-magnetic shell 24. Then with the shell 24 and core 26 of the development roller rotating as illustrated in FIG. 1, the attracted developer 18 on such portion of the surface 28 will be carried at the high counteracting linear velocities $V_3$, $V_4$, the net linear velocity $V_2$ into, and passed, the development zone and hence at 10 for developing the latent images 14. Such development results in spent developer material 30 which, for the reasons discussed above, should be removed.

Accordingly, for removing such spent developer 30 from the surface 28 of the development roller, the apparatus 40 further includes the magnetic skive device 60. As shown, the skive device 60 includes a stationary non-magnetic shell 62 and a rotatable magnetic core 64 consisting of a plurality e.g. (6) of single, alternating N and S pole magnets. Each of such magnets is strong enough to generate a second magnetic field of a second strength about the shell 62, and into an overlapping relationship with the first magnetic field of the closest magnet of the development roller core 26. The magnets, and hence the magnetic fields of the skive 60, are made so that they are stronger than those of the development roller 16, as measured for example, within the area B where such magnetic fields overlap between the shell 24 of the development roller, and the shell 62 of the skive device 60.

In cases where the shell 24 of the development roller 16 and the shell 62 of the skive are spaced a distance of about 0.025", within this area B, magnetic field strengths of 400 Gauss for each development roller magnet, and 900 Gauss for each skive device magnet, have been found to be operatively very satisfactory in affecting the skiving of spent developer from the development roller of the apparatus of the present invention.

FIG. 2 further illustrates a magnetic coupling 66 formed by the magnetic field of each magnet of the development roller overlapping with the magnetic field of the closest magnet of the skive device 60. Coupling 66 is formed as such when the shell 24 and core 26 of the development roller 16 are rotatably driven, for example, clockwise passed the area B. By means of the coupling 66, the momentum of the driven core 26 is transmitted to the rotatable core 64 of the skive device 60, thereby rotatably moving the core 64 in the opposite or counterclockwise direction as illustrated. Utilization of the magnetic coupling 66 instead of a separate drive means for moving the core 64 in this manner, allows the development apparatus 40 to be compact and less costly.

When the core 64 of the skive device 60 is rotatably moved as such by the coupling 66, the skive device 60 effectively operates to skive off and remove spent developer 30 from the surface 28 of the shell 24, as follows. First, the magnetic field of each magnet of the skive device 60, because it is stronger than that of the development roller magnet closest to it, within the area B, will attract the spent developer material 30 away from the surface 28 of the development roller shell 24, and onto the surface of the skive shell 62. As described above, the rotational, counterclockwise movement of the core 64 of the skive 60, and hence of its magnets as caused by the coupling 66, will cause the attracted spent developer 30 on the shell 62 to move in the opposite, that is, clockwise direction as shown by the arrow 68. In effect therefore, the combined impacts of the greater strength, and of such rotation, of the magnets of the core 64 on the spent developer 30, is to move such spent developer away from, and against the movement of, the portion of the surface 28 carrying it. Such away-and-against movement of the spent developer is very effective in skiving off and removing such spent developer from the surface 28.

Additionally, it is important to note that within the area B, the direction of the velocity $V_3$ being induced in the spent developer 30 by the rotating core 26 of the development roller 16 is also against the movement of the surface 28, and hence operates additively with the movement of the same developer being induced in the same direction (arrow 68) by the core 64 of skive device 60. As such, the skiving off and removal of the spent developer 30 within the area B is substantially enhanced by the action therein of the rotating magnets of the core 26 of the development roller 16 moving the spent developer 30 additively in the same direction against the movement of the surface 28, as are the magnets of the skive device 60.

Following such removal from the surface 28, the spent developer 30, as illustrated, is held magnetically onto the surface of the shell 62 and there travels, as shown, until it is removed, for example, by means of a secondary conventional mechanical skive 69. Alternatively, it can also be removed by means of a conventional eccentric shell type skive device, and thereafter allowed to fall back into the sump 48 for remixing by the device 44.

Unlike in the case of a development roller as discussed above, the use of conventional skiving devices to secondarily remove the spent developer 30 from the surface of the skive device 60 as suggested here, is acceptable because, with the device 60, there is no need on the other hand for it to magnetically pick up developer material. Furthermore, any ineffectiveness of such secondary conventional skiving device in removing the spent developer 30 from the skive 60 will not result in poor image quality, and so the use of such conventional skives here is not as critical as it would be in the case of the development roller.

As can be seen, by utilizing the magnetic coupling 66 instead of separate drive means to rotatably move the core 64 of the skive device 60, the development apparatus 40 of the present invention can be made compact and less costly. The skive device 60 also actively and effectively skives and removes spent developer from the development roller 16, and can do so even in a high resolution development apparatus in which the shell and core of the development roller tend to move the spent developer in opposite directions. Finally, such skiving and removal of the spent developer is substantially enhanced by the additive, not oppositive, tendencies of the magnetic cores of the development roller and skive device in moving the spent developer 30 from the surface 28 of the development roller.

Although the description of the invention has been made with particular reference to a preferred embodiment, it is understood that modifications and variations can be effected within the spirit and scope of the invention.

What is claimed is:

1. In an electrostatographic copier or printer, a development apparatus including:

(a) a development roller consisting of a first non-magnetic shell and a first magnetic core thereto, said first magnetic core generating a first magnetic field about said first shell, and said first shell and said first core being drivable so as to pick up and carry fresh developer on said shell for developing electrostatic latent images on an image-bearing member;

(b) means for skiving and removing spent developer from said first shell, said skiving means including a second stationary non-magnetic shell located adjacent said first shell, and a rotatable second magnetic core to said second shell, said second magnetic core generating a second magnetic field about said first shell, and said second core being rotatable in order to effect the skiving and removal of developer from said first shell and onto said second shell; and (c) a magnetic coupling for magnetically rotating said second core when said first core of the development roller is driven, said magnetic coupling being formed by said first and said second magnetic fields, said second magnetic core of said skiving means being rotated by said magnetic coupling in a direction opposite to that of said first magnetic core of the development roller such that in the area between said first and said second shells, said first and said second magnetic cores additively tend to force the spent developer to travel in the same direction.

2. The apparatus of claim 1 wherein said first magnetic core of the development roller comprises a first plural number of single, alternating N and S pole magnets each generating one said first magnetic field, and wherein said second magnetic core of said skiving means similarly comprises a second plural number of single, alternating N and S pole magnets, each generating one said second magnetic field.

3. The apparatus of claim 2 wherein said second plural number of magnets of said core of said skiving means is equal to said first plural number of magnets of said core of said development roller.

4. The apparatus of claim 1 wherein the magnetic strength of said second magnetic field, within the area between said first shell of the development roller and said second shell of the skiving means, is greater than that of said first magnetic field.

5. The apparatus of claim 1 wherein said first shell and said first magnetic core of the development roller are driven in the same direction.

6. The apparatus of claim 1 wherein within the area between said first and said second shells, said first and said second cores, in order to be more effective, additively tend to move the spent developer in a common direction against the direction of travel of said first shell.

7. In an electrostatographic copier or printer, a development apparatus including:

(a) a magnetic development roller consisting of a first non-magnetic shell and a first magnetic core for picking up and carrying fresh developer material within said apparatus, said magnetic development roller generating a first magnetic field therein;

(b) a rotatable magnetic skiving means, including a second stationary non-magnetic shell for skiving spent developer from said development roller, said magnetic skiving means additionally generating a second magnetic field therein; and (c) a magnetic coupling, formed by said first and said second magnetic fields, for magnetically rotating said skiving means, said second magnetic core of said skiving means being rotated by said magnetic coupling in a direction opposite to that of said first magnetic core of the development roller such that in the area between said first and said second shells, said first and said second magnetic cores additively tend to force the spent developer to travel in the same direction, thereby effectively skiving and removing such spent developer material from the development roller.

8. A development apparatus for use in an electrostatographic copier or printer to develop latent electrostatic images with developer material, the development apparatus comprising:

(a) a development roller including a first non-magnetic shell rotatable in a first direction for carrying magnetic developer material on the outside surface thereof at a first velocity in said first direction, and a first magnetic core mounted within said first non-magnetic shell, said first magnetic core being rotatable in said first direction for causing the magnetic developer material on said first non-magnetic shell to move at a second velocity thereon in a second direction opposite said first direction, and said second velocity being less than said first velocity such that a net velocity of the magnetic developer material on said first non-magnetic shell is in said first direction; and (b) magnetic skiving means for removing the magnetic developer material from the outside surface of said first non-magnetic shell, said magnetic skiving means including a stationary second non-magnetic shell located adjacent said first non-magnetic shell forming a skiving nip area, and a second magnetic core mounted within said stationary second non-magnetic shell, said second magnetic core being rotatable so as to be moving in the same direction within said skiving nip area as said first magnetic core thereby additively with said first magnetic core causing the magnetic developer material within said skiving nip area to move in said second direction opposite said first direction.

9. The development apparatus of claim 8 wherein said second magnetic core of said skiving means is rotatable magnetically by means of magnetic couplings formed therewith by said first magnetic core of said developer roller.

10. A development apparatus for use in an electrostatographic copier or printer to develop latent electrostatic images with developer material, the development apparatus comprising:

(a) a development roller including a first non-magnetic shell rotatable in a first direction for carrying magnetic developer material on the outside surface thereof at a first velocity in said first direction, and a first magnetic core mounted within said first non-magnetic shell, said first magnetic core being rotatable in said first direction for causing the magnetic developer material on said first non-magnetic shell to move at a second velocity thereon in a second direction opposite said first direction, and said second velocity being less than said first velocity such that a net velocity of the magnetic developer material on said first non-magnetic shell is in said first direction;

(b) magnetic skiving means for removing the magnetic developer material from the outside surface of said first non-magnetic shell, said magnetic skiving means including a stationary second non-magnetic shell located adjacent said first non-magnetic shell forming a skiving nip area, and a second magnetic core mounted within said stationary second non-magnetic shell, said second magnetic core being rotatable so as to be moving in the same direction within said skiving nip area as said first magnetic core thereby additively with said first magnetic core causing the magnetic developer material within said skiving nip area to move in said second direction opposite said first direction; and (c) a magnetic coupling for magnetically rotating said second magnetic core when said first magnetic core of the development roller is driven, said magnetic coupling being formed by a first magnetic field of said first magnetic core and a second magnetic field of said second magnetic core.

* * * * *